US006027312A

United States Patent [19]

Djordjevic

[11] Patent Number: 6,027,312

[45] Date of Patent: Feb. 22, 2000

[54] HYDRAULIC PRESSURE SUPPLY PUMP WITH SIMULTANEOUS DIRECTLY ACTUATED PLUNGERS

[75] Inventor: Ilija Djordjevic, East Granby, Conn.

[73] Assignee: Stanadyne Automotive Corp., Windsor, Conn.

[21] Appl. No.: 08/959,836

[22] Filed: Oct. 29, 1997

[51] Int. Cl.[7] ..... F04B 19/02

[52] U.S. Cl. ..... 417/53; 417/265; 417/298; 417/462; 123/446

[58] Field of Search ..... 417/462, 265, 417/298, 486, 487, 488, 53; 123/446, 450

[56] References Cited

U.S. PATENT DOCUMENTS

| | | | |
|---|---|---|---|
| 3,970,414 | 7/1976 | Mowbray | 417/462 |
| 4,125,104 | 11/1978 | Stein | 417/462 |
| 4,667,638 | 5/1987 | Igashira et al. | 123/446 |
| 4,883,409 | 11/1989 | Strohmeier et al. | 417/265 |
| 5,318,001 | 6/1994 | Djordjevic | 417/462 |
| 5,688,110 | 11/1997 | Djordjevic | 417/265 |
| 5,884,606 | 3/1999 | Kellner et al. | 123/446 |
| 5,888,054 | 3/1999 | Djordjevic | 417/265 |

*Primary Examiner*—Charles G. Freay

*Attorney, Agent, or Firm*—Alix, Yale & Ristas, LLP

[57] ABSTRACT

A pump and associated method including the steps of pre-metering successive quantities of fuel from a reservoir to a positive displacement transfer pump, then actuating the transfer pump to raise the pressure of the successive quantities of fuel by at least about 100 psi, preferably 200–300 psi. Each quantity of fuel which was pressurized in the transfer pump, is delivered to a high pressure pumping chamber so that each pumping bore receives a certain, i.e., predetermined, charge of fuel within a first time interval. A plurality of plungers in the respective pumping bores are then simultaneously actuated to increase the pressure in the pumping chamber to the desired high pressure, preferably at least about 15,000 psi, within a second time interval, and to discharge the quantity of fuel through a high pressure discharge valve. The second time interval is of longer duration than the first time interval. As a result, the necessary quantity of fuel can be delivered to the pumping chamber in a relatively short time period. Therefore, each pumping plunger can be actuated by a dual rate cam profile over a relatively long time period such that at steady state the actuation occurs only along a relatively shallow slope of the cam profile, whereas when acceleration is required, the actuation can occur more quickly, along a steeper profile, before continuing along the relatively shallow profile.

26 Claims, 6 Drawing Sheets

HYDRAULIC PRESSURE SUPPLY PUMP WITH SIMULTANEOUS DIRECTLY ACTUATED PLUNGERS

BACKGROUND OF THE INVENTION

The present invention relates to high pressure hydraulic pumps, and particularly to pumps for supplying diesel fuel at high pressure in a fuel injection system for vehicles.

Rotary hydraulic pumps for use in diesel fuel injection systems for internal combustion engines, have been well known for a number of years. Recently, desired improvements in fuel efficiency and emissions control, have led the automotive industry toward development of so-called common rail fuel injection systems, whereby a high pressure pump is utilized to establish and maintain a high fuel pressure in an accumulator in fluid communication with individual injectors. Individual injection events are controlled at the injectors for achieving combustion in the individual combustion chambers of the internal combustion engine. This is in contrast to the more common distributor type fuel injection pumps, whereby fuel pulses are distributed from within the pump, to individual distribution paths leading to a respective plurality of injectors.

Common rail pumps are expected to operate at about 20,000 psi, whereas conventional distributor pumps operate at less than about 10,000 psi. This difference accentuates certain drawbacks in conventional pumps, such as an excessive amount of fuel that experiences pressurization in connection with the pumping action, and the excessive amount of heat carried by fuel which pressure pumping, but which is not actually injected into the combustion chambers.

Unfortunately, many of the disadvantages of distributor type pumps in this regard, have been carried over into attempts to modify the distributor type pumps, for use in common rail systems. The problem of excess pumping and associated heat generation, arise especially in the so-called pump-spill, spill-pump-spill, and fill-spill techniques, as exemplified in commonly owned U.S. Pat. No. 5,215,449 and co-pending U.S. application Ser. No. 08/459,032 filed Jun. 2, 1995. The reluctance in setting aside such spill-type pumps, is that the fuel delivery requirements on the pump can vary considerably depending on, for example, whether the pump is starting from a cold condition, whether the pump is running at a sustained, steady state condition, and whether acceleration is required to handle an increased load. With the spill-type pumps, a quantity of fuel is delivered to the pump in an amount greater than any necessary requirement, and spill control is utilized during pumping, to try to match the quantity discharged from the pump, with the instantaneous requirements.

Other techniques attempt to match fuel quantities delivered to the pumping chamber, with the instantaneous requirements, e.g., pre-metering based on computations of pump demand by an electronic control unit (ECU). This pre-metering of the fuel quantity to be charged into the pumping chamber is typically controlled by a solenoid valve responsive to a control signal from the ECU. A major disadvantage of solenoid-implemented pre-metering, is the relatively long duration required for the metering of a useful quantity of fuel through the solenoid valve, and the difficulty to adjust the metered quantity over a wide range according to the needs of the engine. In many instances, the intake phase of pumping chamber operation with pre-metering, would not leave sufficient time to implement the pumping phase using a cam pumping rate profile shallow enough to assure quiet operation. Even with dual-rate pumping profiles, there is not enough time available during the pumping phase of a cycle, to incorporate such duality.

SUMMARY OF THE INVENTION

It is, therefore, an object of the present invention to provide a high-pressure hydraulic pump which minimizes the quantity of fuel charged in the pumping chamber during the intake phase of operation, is highly energy efficient during steady state pumping operation, yet can respond quickly to transients, such as acceleration.

It is another object that such pump provide quiet operation during steady state operation.

It is a further object that such pump take advantage of the hydraulic efficiency associated with inlet metering, yet achieve high discharge pressure, in excess of 20,000 psi, while utilizing a relatively simple and inexpensive metering device.

These objects are achieved according to the inventive method including the steps of pre-metering successive quantities of fuel from a reservoir to a positive displacement transfer pump, then actuating the transfer pump to raise the pressure of the successive quantities of fuel by at least about 100 psi, preferably 200–300 psi. Each quantity of fuel which was pressurized in the transfer pump, is delivered to a high pressure pumping chamber defined in part by a plurality of fluidly interconnected high pressure pumping bores, so that each pumping bore receives a certain, i.e., predetermined, charge of fuel within a first time interval. A plurality of plungers in the respective pumping bores are then simultaneously actuated to increase the pressure in the pumping chamber to the desired high pressure, preferably at least about 15,000 psi, within a second time interval, and discharging the quantity of fuel through a high pressure discharge valve. The second time interval is of longer duration than the first time interval. The first time interval can be relatively short, because the pumping chamber is charged by the transfer pump at a pressure of at least about 100 psi, which is considerably higher than the conventional charging pressure. As a result, the necessary quantity of fuel can be delivered to the pumping chamber in a relatively short time period. Therefore, each pumping plunger can be actuated by a dual rate cam profile over a relatively long time period such that at steady state the actuation occurs only along a relatively shallow slope of the cam profile, whereas when acceleration is required, the actuation can occur more quickly, along a steeper profile, before continuing along the relatively shallow profile.

Preferably, the initial pumping phase actuation rate, whether on the shallow or the steeper profile, is dependent on the volume of pre-metered fuel, which is commensurate with the quantity of fuel actually charged into the pumping chamber.

The method is preferably implemented in a high pressure supply pump with a central pumping chamber and multiple inwardly actuated pumping plungers. A common cam ring directly actuates a single positive displacement transfer pump and directly activates the plungers of the high pressure pump. The cam ring preferably has an outer cam profile cooperating with a roller shoe assembly associated with an actuating piston in the transfer pump, and an inner profile cooperating with a roller shoe assemblies associated with the plurality of high pressure pumping plungers to activate the plungers simultaneously.

The cam of the pump implemented according to the present invention, can therefore have a high pressure pumping phase profile that is long and shallow (i.e., a small slope), to thereby minimize hydraulic as well as acoustic noise. A greater portion of the pumping cycle can be allocated to high pressure pumping, because the charging ramp on the transfer cam profile can be relatively short and steep, due to the higher charging pressure generated by the piston type transfer pump actuated directly by the external cam profile.

Thus, the transfer pump chamber is filled by a pre-metered quantity of fuel during the relatively long high pressure pumping phase. The pre-metered fuel quantity is calculated by the electronic control unit, depending on the desired fuel delivery and the desired accumulator pressure. The pumping event ends when the plunger rollers reach and travel over the cam nose. Because of the absence of spilling, the system need not include means to handle the heat which would have accompanied spilled fuel. The dead volume is quite small, and thereby helps minimize the retraction quantity, which is beneficial for loading duration and pump efficiency. No filling takes place during the time that the accumulator pressure drop is desired.

It can be appreciated that the high hydraulic efficiency due to inlet metering provides the advantage that during steady state operation, only the required amount of fuel is charged into the pumping chamber and pressurized to the desired accumulator pressure level. This condition prevails during perhaps 99% of the time the pump is in operation. Only during the transition from high pressure to low pressure fuel requirement (i.e., such as during start up), would fuel be dumped back into the reservoir, and only from the accumulator, not the pump. This is in contrast to conventional pumps, wherein at least 50% of pressurized fuel is dumped from the pump, just to maintain steady accumulator pressure. As a result of the inlet metering, a lower volume of hot fuel returns into the tank, thereby reducing fuel cooling problems.

Because the metering device itself is not required to supply the charging pressure above 100 psi for filling the high pressure pumping chamber during a short interval, a relatively inexpensive metering device, for example, an ordinary gasoline injector, can be used. The metering event is spread out over a relatively long time period as compared with the charging event. Because the pump is inlet metered, the pump can have substantial over capacity, without wasting energy. The energy input for an over capacity charge is expended only as needed.

Another advantage of the present invention, is that the pumping force is distributed over several pumping elements, in a balanced manner. Furthermore, the transfer pump actuation and the high pressure pumping actuation events can be separated in time, resulting in lower peak torque on the rotary components. If desired, synchronization with the engine is possible.

BRIEF DESCRIPTION OF THE DRAWINGS

These and other objects and advantages of the invention will be described in greater detail below with reference to the accompanying drawings, in which.

DESCRIPTION OF THE PREFERRED EMBODIMENT

Figure 1:
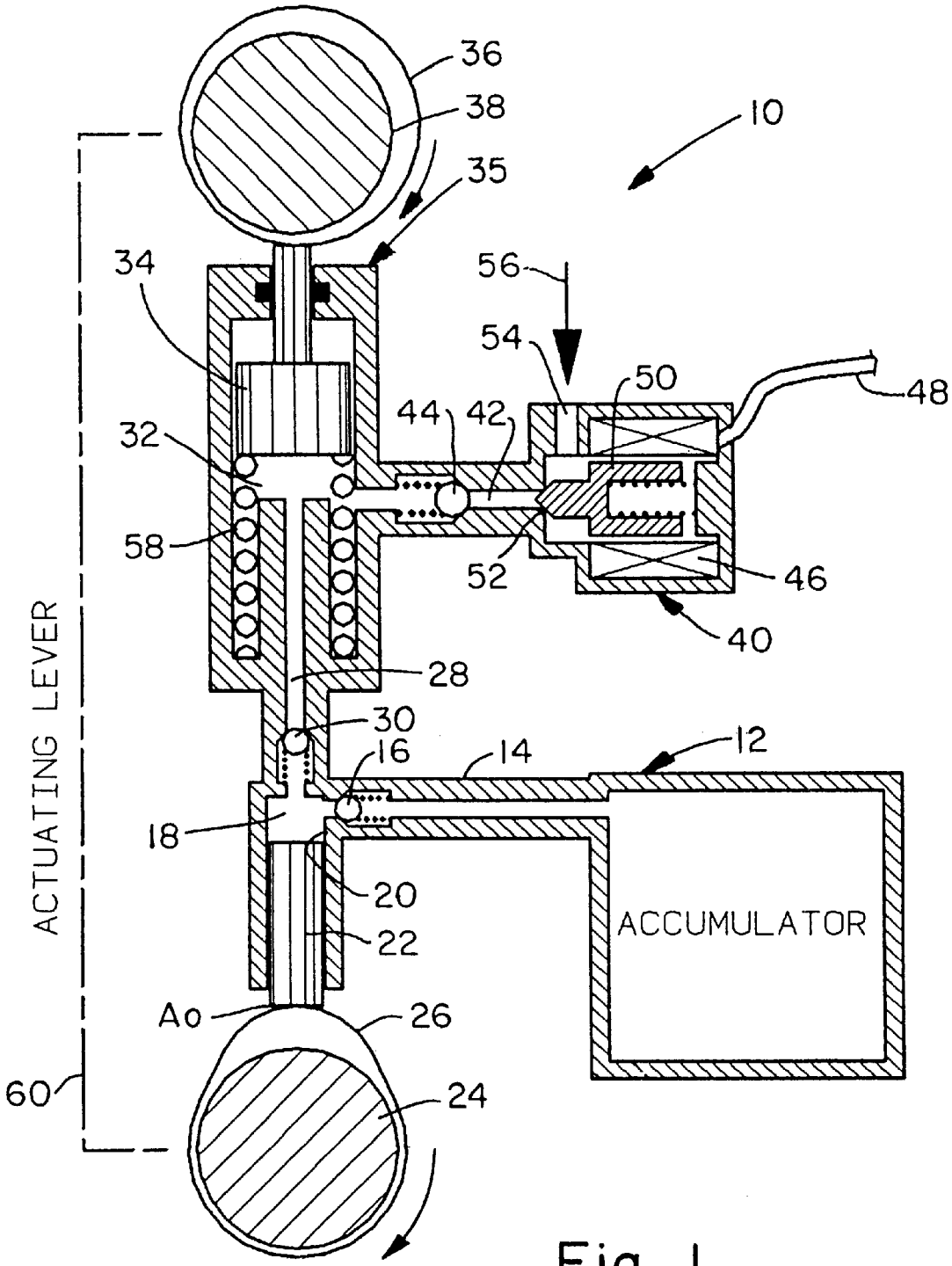
FIG. 1 is a schematic of a portion of a common rail fuel injection system incorporating the high pressure pump assembly of the present invention.

FIG. 1 shows schematically the essence of the operating principle of a high pressure fuel supply system 10, according to the present invention. In the illustrated embodiment, the system 10 is arranged to supply high pressure fluid, such as diesel fuel, to an accumulator 12, for ultimate injection into a diesel engine (not shown). In such a so-called common rail fuel injection system, the accumulator pressure must be maintained at about 20,000 psi, even as the fuel is continually injected from the accumulator 12 into a plurality, e.g., four, six, or eight, engine cylinders.

High pressure fuel is delivered via line 14 through check valve 16, from the pumping chamber 18. The chamber 18 is formed at least in part by a bore 20 in which a pumping plunger 22 can reciprocate, in a manner well known in this field of technology. The plunger is directly driven by a rotating cam 24 having a cam profile 26. While the plunger retracts, thereby enlarging the available volume in pumping chamber 1 8, fuel is supplied via inlet passage 28 through check valve 30. When the plunger 22 advances, the fuel in chamber 18 is delivered to the accumulator 12.

In accordance with the present invention, fuel is supplied through the inlet passage 28 at a pressure preferably in the range of about 200–300 psi, into high pressure pumping chamber 18, by a positive displacement transfer pump 35, preferably including a transfer pumping chamber 32 and associated pumping plunger or piston 34. In practice, and as described more fully below, the system 10 would have a high pressure pumping chamber 18 formed by a plurality of pumping plungers and their respective bores, but only a single transfer pumping chamber 32 adapted to supply all the high pressure pumping bores. The transfer pump piston 34 is driven directly by a rotating cam 38 having a cam profile 36 which is different from, but has a pre-established timing relationship with, the cam profile 26.

A further aspect of the invention, is that the fuel supplied to the transfer pump chamber 32 via passage 42 through check valve 44, is pre-metered, such as by a solenoid driven valve 40. Electromagnet 46 is energized or de-energized via leads 48, to retract or advance valve member 50, away from or against valve seat 52. This admits or blocks the flow of fuel from the low pressure supply line 56 from the fuel tank supply pump (not shown), through passage 54 into passage 42. This fuel is typically at a pressure of less than about 20 psi, preferably 10–15 psi. The fuel supply at this low pressure can be considered a reservoir.

The valve 40 is relatively slow in operation, but as a consequence, is relatively accurate in the quantity of fuel that can be metered into chamber 32. The quantity of metered fuel from valve 40 can be regulated according to the demand on the engine, e.g., during acceleration, in a well known manner. (For example by an ECU such as described in U.S. Pat. No. 5,103,792, "Processor Based Fuel Injection Control System", the disclosure of which is hereby incorporated by reference.) The volume of the chamber 32 and the pre-load on the associated piston return spring 58, assure that any potentially desirable quantity of metered fuel can be received in chamber 32 for delivery through passage 28.

According to another preferred aspect of the present invention, the cam 24 and cam 38 are in rigid, fixed relation to each other, forming an actuating lever 60 which automatically coordinates the phasing of the relationship between the plunger 22 and the piston 34. Such phasing can be understood with reference to FIGS. 2 and 3. The upper portions of FIGS. 2 and 3 represent the transfer pump chamber 32 and piston 34 as controlled by cam profile 36, whereas the lower portions represents the high pressure pumping chamber 18 and plunger 22 as controlled by cam profile 26.

Point A on the profile 26 corresponds to the cam nose, or peak displacement of plunger 22, at zero rotation angle of cam 24, and point B on the profile 36 corresponds to the minimum displacement of piston 34 at zero rotation angle of cam 38. The complete cycle of one profile 26 from A to A1 and one profile 36 from B to B1, is represented along a scale of zero to 100 per cent. As the piston 34 follows the upslope of portion 62 of profile 36, the fuel in chamber 32 is discharged into the chamber 18, because the plunger 22 is retracting as it follows the downslope of cam portion 64. The charge of fuel delivered to chamber 18 is thus commensurate with (and preferably equal to) the pre-metered quantity to chamber 32. During steady state operation, the quantity of fuel in chamber 32 delivered to chamber 18, only partially fills chamber 18, as shown at 40 per cent scale. Chamber 18 does not fully expand, but rather reaches an intermediate limit at about 20 per cent scale (point 76), and remains at that limit until just past 60 per cent scale. The downslope, minimum, and upslope portions defined by segments 76 to 66; 66 to 68; and 68 to 78 do not influence the fuel volume ultimately charged in the chamber 18 At point 78, the plunger 22 advances through chamber 18 to develop the high pressure for delivery to the accumulator 12.

As the piston 34 follows the downslope portion 61 of cam profile 36, the chamber 32 expands to receive the metered supply of fuel via valve 40. This quantity is delivered during a relatively long period of time during which the high pressure plunger 22 is delivering fuel from the chamber 18 to accumulator 12, as a result of the upslope on portion 74 of profile 26. The quantity of fuel supplied to chamber 32 is calculated by an on-board computer or regulator (not shown) depending on the desired fuel delivery to the engine and the desired accumulator pressure. The maximum displacement of the transfer pump piston 34 is slightly smaller than the maximum displacement of the high pressure plunger 22 (e.g., 10 per cent less) in order to avoid hydraulic lock and to protect the pump components from mechanical overstress.

Figure 2:
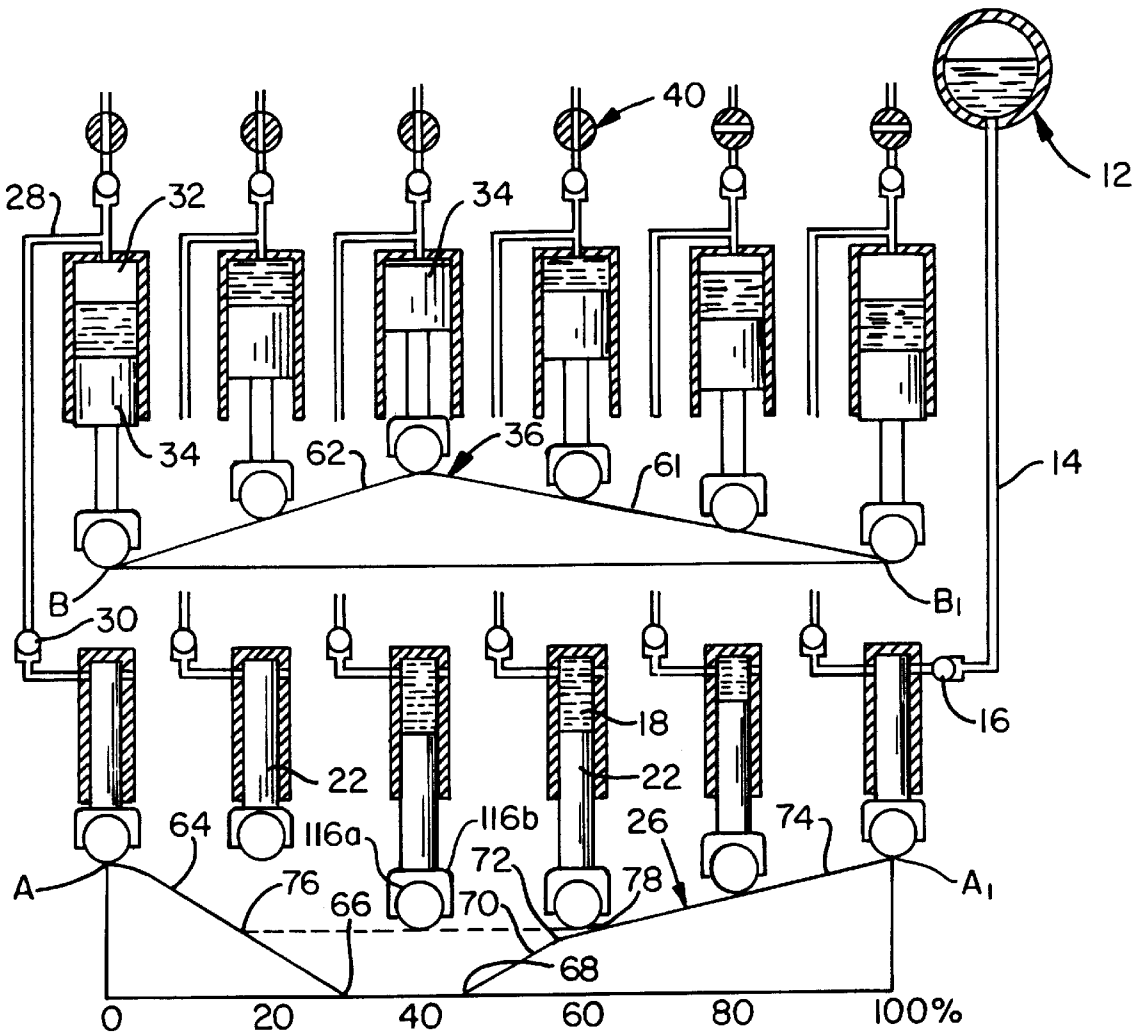
FIG. 2 is a schematic of the interaction of the transfer pump and high pressure pump for the timing of maximum fuel delivery during steady state operation and constant accumulator pressure.
Figure 3:
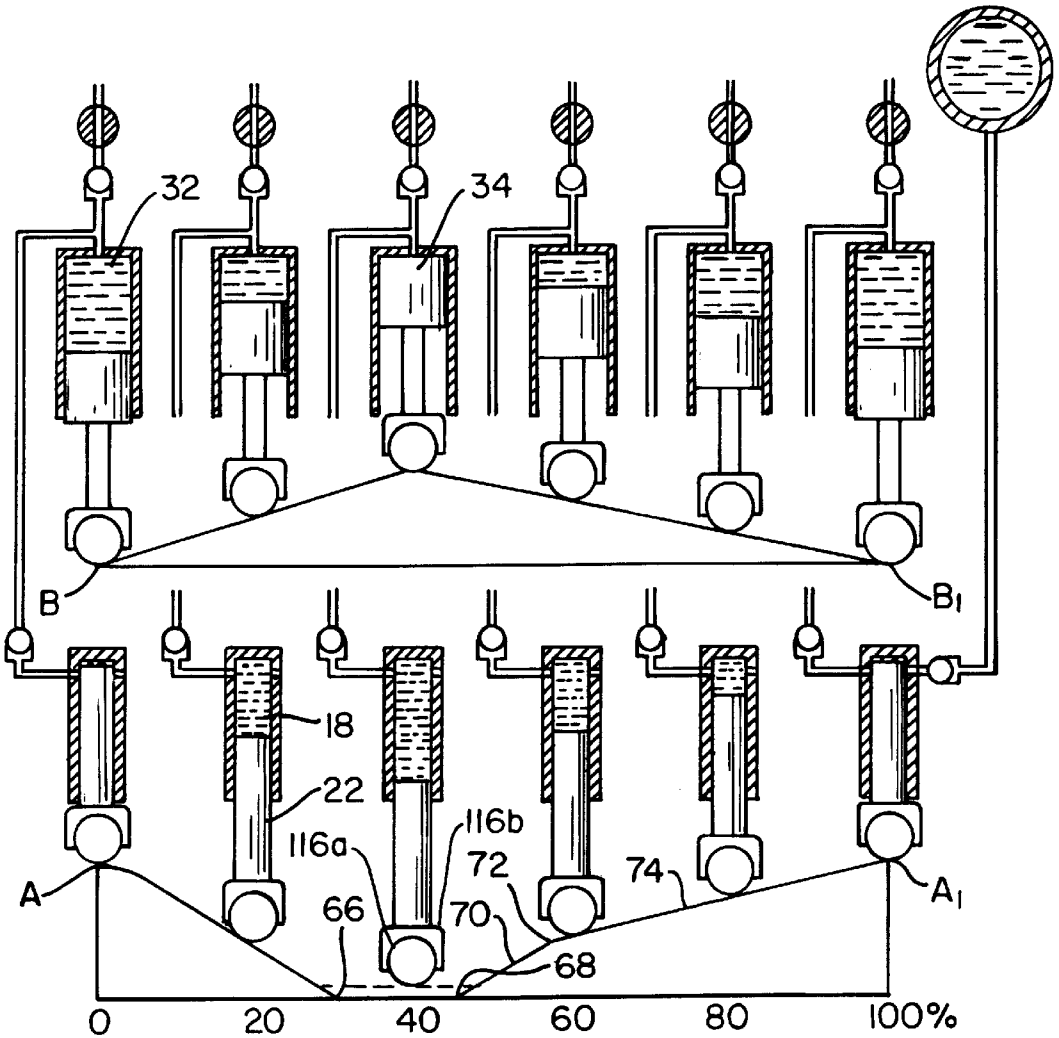
FIG. 3 is a schematic of the interaction of the transfer pump and high pressure pump for the timing of maximum fuel delivery during transient operation and simultaneous accumulator pressure increase.

It can be appreciated from FIGS. 1 and 2, that the normal pumping rate of cam profile 26 is relatively low (i.e., a gradual and relatively long upslope 74 along almost 40 per cent of scale), which minimizes both hydraulic and acoustic noise. This has been achieved because the necessary quantity of fuel is delivered to the pumping chamber 18, over a relatively short time period (i.e., during less than about 20 per cent of scale on the steep downslope 64).

A significant aspect of the present invention, is providing an inexpensive, easily controlled transfer pump arrangement which is capable of delivering a metered quantity at high pressure over a short time interval. The quantity is controllable by the use of an inexpensive valve 40, because the time available for metering quantity, is relatively long, i.e., the full length of profile 61. Yet the metered quantity can be delivered to charge chamber 18 at a pressure of, for example, 200–300 psi, thus requiring only a short delivery time interval. This is in contrast to conventional transfer pumps, which typically operate at less than about 15 psi, and thus require a considerably longer time interval to charge the same quantity.

The capability of the present invention to charge the high pressure pumping chamber 18 during a short interval (e.g., within about 10–20 per cent of scale rotation of cam 26 for steady state operation), not only permits the use of a long, gradually ascending profile 74 for the driving of the high pressure plunger 22, but further permits accommodation of a dual ascending rate. This is shown in FIG. 2, as a short, rapidly rising profile 70, between points 68 and 72, followed by the longer, lower rate portion 74. The slope of profile portion 70 is preferably at least twice as steep as that of profile portion 74. During steady state, the chamber 18 does not completely fill, so the high rate portion 70 is not utilized. This is represented by the dashed line extending between points 76 and 78, whereby the plunger 22 "floats" for a duration of about 40 per cent scale.

During demand for faster accumulator pressure increase associated with acceleration, the valve 40 admits a higher quantity of fuel to chamber 32, which corresponds to a longer duration on portion 64 of profile 26, almost to point 66, thereby nearly filling chamber 18. This situation is explained with respect to FIG. 3. The plunger 22 then floats along a "flat" transition profile between 66 and 68, before quickly rising along portion 70 and then continuing the pumping action along the "steady state" slope 74 between points 72 and A1. The portion 70 used for acceleration, preferably spans a duration of about 10–15 per cent of scale. Even in the transient operation depicted in FIG. 3, the plunger 22 floats for a duration of about 20 per cent scale, on an oil film indicated at the arrows. The plunger 22 thus releases the cam force loading the shoe 116*b* for a certain time period to allow the roller 116*b* to replenish the oil film inside of the shoe. Preferably, the volummetric charging rate into chamber 22 is at least 50% faster than the acceleration pumping rate due to cam profile portion 70.

The point 78 at which the roller begins the pumping phase on profile 26 by actuating plunger 22 inwardly, depends on the volume of fuel transferred from chamber 32 into the pumping chamber 18. This volume is commensurate with, and preferably substantially equal to, the volume of fuel metered by valve 40 during the intake stroke of piston 34 along transfer cam portion 61. The charge of fuel delivered by the piston stroke along cam portion 62 through path 28, is predictably allocated in the pumping chamber so each of the plunger bores receives approximately the same amount of fuel during charging.

Figure 4:
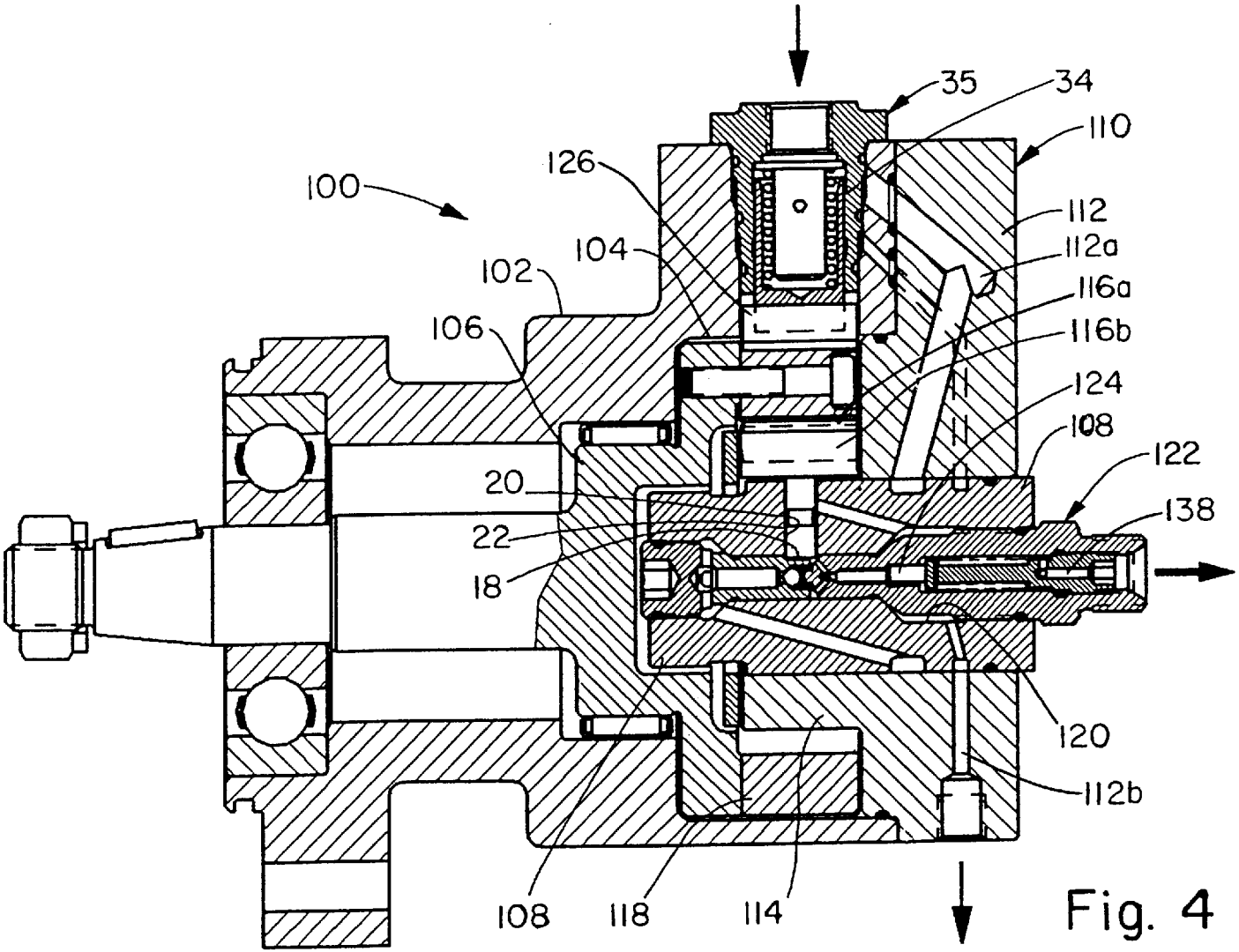
FIG. 4 is a longitudinal section view of a common rail supply pump assembly for implementing the features shown schematically in FIGS. 1–3.
Figure 5:
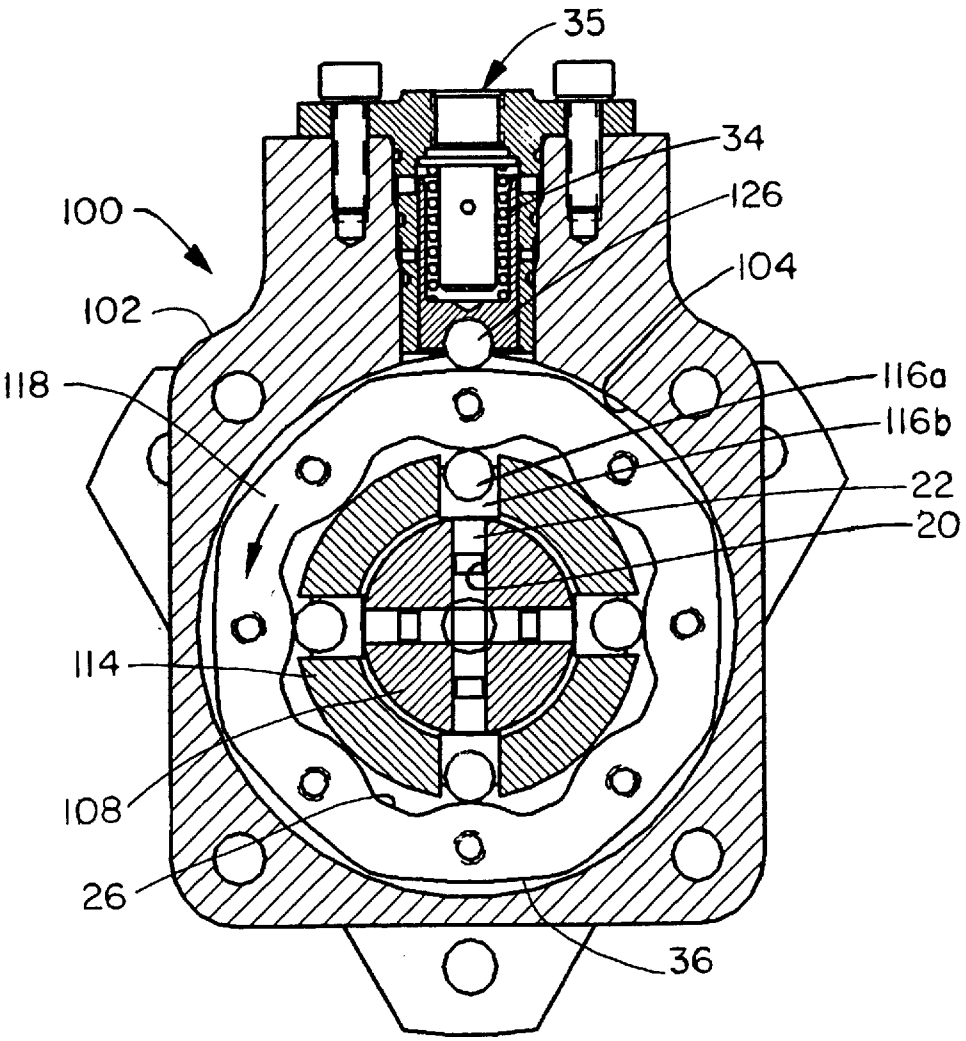
FIG. 5 is an illustrative cross section view of the pump shown in FIG. 4.

FIGS. 4 and 5 show longitudinal and cross sectional views of a preferred embodiment 100 for implementing the inventive features described above. A pump shaft housing 102 has a central cavity 104 in which a drive shaft 106 is supported for rotation. A stationary and rotationally fixed body 108 is situated in part within housing 102 and coaxially aligned with the shaft. Fixed head 110 is secured to housing 102 and has a low pressure fluid handling portion 112 including low pressure supply and leak off channels 112*a*, 112*b*, and a roller shoe support hub portion 114. The hub 114 lies within housing 102 and surrounds body 108. The shaft housing 102 and head 110 together can be considered as defining the housing of the pump assembly.

The associated roller assembly 116 is situated concentrically inside the cam ring 118, which rotates as a result of fixation to the shaft 106. Four radially extending, orthogonally oriented bores 20 in the body 108 contain a respective four reciprocable plungers 22 which cause the respective pumping volummes to expand and contract. The pumping chamber 18 is formed at the intersection of the bores 20 in central cavity 120 of body 108. A high pressure outlet fitting 122 is fixedly supported within the cavity 120, and an axially slidable control valve 124 is supported within the fitting 122. The cam ring 118 surrounds the pumping plungers 22 and, in a manner well known in this field, a cam pumping profile 26 along the inner circumference of the ring, cooperates with cam rollers 116*a*, and associated shoes 116*b*, to reciprocate the plungers 22. This overall arrangement is analogous to that described in U.S. Pat. No. 5,215,449 issued Jun. 1, 1993 and U.S. application Ser. No. 08/459,032 filed Jun. 2, 1995, now U.S. Pat. No. 5,688,110 (the disclosures of which are hereby incorporated by reference).

The outer circumference of the cam ring 118 also provides a cam profile 36, for maintaining rolling contact with an outer roller 126 which causes reciprocation of the piston 34 in the transfer pump 35. The cam ring as shown in FIG. 5, is rotatable counterclockwise and is depicted at the "zero" angle of rotation on the scale for profile 26, wherein the high pressure pumping roller 116*a* is on the nose of the pumping profile, corresponding to point A in FIG. 2. The transfer roller 126 is at the lowest point B of the cam profile 36 as shown in FIG. 2. Rotation of the cam ring until point Al arrives at the former location of point A, corresponds to one pumping cycle. The total travel corresponding to one such cycle can be expressed in a number of equivalent ways, for example, as "100 per cent of a pumping cycle", or as the angular displacement of the cam ring 118 which in the illustrated embodiment is 45 degrees. Clearly, for a different number of plungers or actuation frequency, 100 per cent of a pumping cycle could correspond to a different angular displacement, such as 60 degrees or 90 degrees.

In the embodiment of FIG. 4, the roller 126 for the transfer pump is in vertical alignment with the rollers 116*a* for the high pressure pump, but this is not necessary. Furthermore, only one transfer pump 35 serves all high pressure pumping bores 20. Fuel is transferred to all pumping bores simultaneously during a relatively short portion of the pumping cycle, and thereafter all plungers 22 are driven inwardly simultaneously during a longer portion of the pumping cycle.

In general, advantageous use of the invention as described above with respect to FIGS. 1–5, can be realized within the range of parameters shown in Table 1:

TABLE 1

| Feature | Scale Duration | Numeric ID |
|---|---|---|
| Transfer Cam Profile | 100 percent | 36 |
| intake portion | >50 percent | 61 |
| discharge portion | <50 percent | 62 |
| Pumping Cam Profile | 100 percent | 26 |
| nose portion | <5 percent | A |
| charging portion | 20–30 percent | 64 |
| flat portion | 10–30 percent | 66 to 68 |
| acceleration portion | 10–20 percent | 70 |
| steady state portion | 30–60 percent | 74 |

Figure 6:
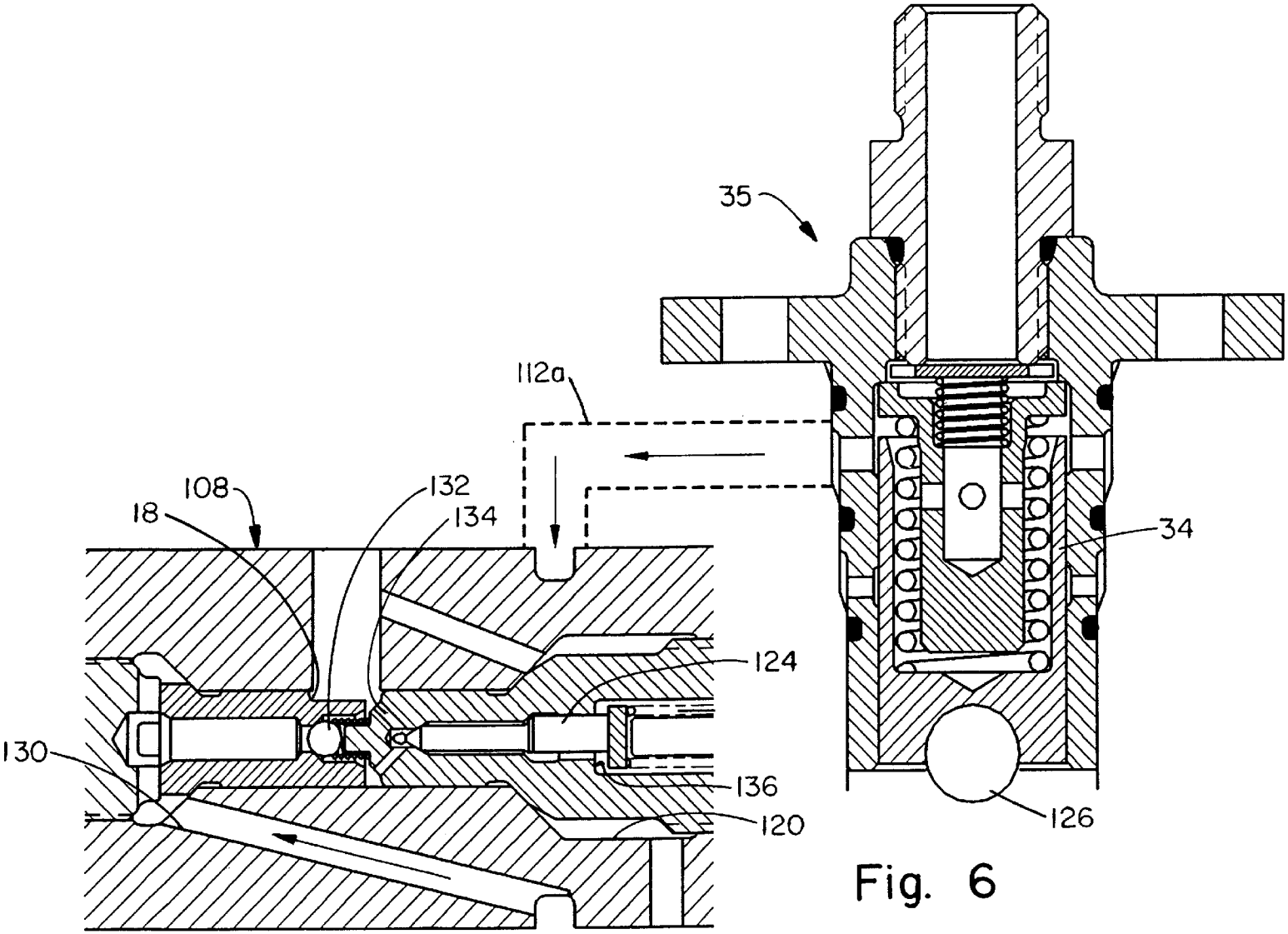
FIG. 6 is a schematic of the charging operation of the components of the pump shown in FIG. 4.

The preferred implementation of the cooperation between the transfer pump 35 and the control valve 124 for discharging the high pressure pumping chamber 18, is shown schematically in FIG. 6. The transfer pump 35 is particularly well suited for rapidly transferring a metered volume of fuel to the control valve 132, to charge the pumping chamber during only a short duration of the retraction of the pumping plungers 22 along cam profile portion 64 (e.g., <20 per cent of scale during steady state maximum fuel delivery, as shown in FIG. 2). Also, the transfer pump phasing offset and reduction in the number of seals between the transfer pump and the high pressure chamber permits the transfer pump itself to initially charge the accumulator to a pressure of about 200–300 psi, before the high pressure pumping takes over. This can substantially reduce the cranking time and reduce the pressurized response time whenever required for a cold engine. As shown with greater particularity in FIG. 6, the transfer pump roller 126 actuates transfer piston 34, whereby fuel is delivered via low pressure supply line 112*a*, into the exterior groove in pump body 108, whereupon the fuel is delivered via inlet passage 130 to check valve 132. Check valve 132 opens during the intake phase of pumping operation, thereby delivering fuel into the pumping chamber 18 whereupon, as the plungers (not shown in FIG. 6) are actuated radially inwardly, the inlet check valve 132 closes. The control valve 124 is normally spring biased to prevent passage of fuel through high-pressure passages 134 during the intake phase, but during the pumping phase, the valve 124 opens, so that high pressure fuel is delivered via high pressure passages 134 and valve cavity 136, to the discharge port 138 (see FIG. 4).

I claim:

1. A method for operating a cam actuated high pressure hydraulic pump, comprising:

pre-metering successive quantities of fuel from a reservoir to a positive displacement transfer pump, at a pressure less than about 20 psi;

actuating the transfer pump to raise the pressure of the successive quantities of fuel by at least about 100 psi;

delivering each quantity of fuel which was pressurized in the transfer pump, to a high pressure pumping chamber including a plurality of fluidly interconnected high pressure pumping bores so that each bore receives a certain charge of fuel within a first time interval;

simultaneously actuating a plurality of plungers into respective pumping bores to increase the pressure in the pumping chamber by at least about 15,000 psi within a second time interval, and thereby discharging said quantity of fuel from the pumping chamber through a high pressure discharge valve;

wherein each plunger is actuated by a dual rate cam pumping profile such that the actuation rate is dependent on the volume of said charge of fuel; and wherein said second time interval is of longer duration than said first time interval.

2. The method of claim 1, wherein during steady state operation the successive metered quantities are substantially identical and each plunger is actuated at a relatively low rate; and during transient operation successive metered quantities increase and each plunger is actuated at an initial relatively high rate followed by said relatively low rate.

3. The method of claim 1, wherein the transfer pump and the high pressure pump are directly actuated by a common cam ring.

4. The method of claim 1, wherein the step of pre-metering is preceded by determining a desired pre-metered fuel charging quantity in response to a control system computation of desired fuel delivery and desired accumulator pressure.

5. The method of claim 1, wherein the transfer pump has a maximum displacement and the high pressure pump has a maximum displacement which is greater than the transfer pump maximum displacement.

6. The method of claim 1, wherein each pumping plunger is driven during the high pressure pumping event by a roller which follows a cam pumping profile and the pumping event ends without spilling, when each roller reaches and travels over a nose on a respective profile.

7. The method of claim 1, wherein the transfer pumping of said charge to the pumping bores is separated in time from the high pressure pumping event.

8. The method of claim 1, wherein the pump is associated with an internal combustion engine and transfer pump actuation and the high pressure pump actuation are synchronized with combustion events in the engine.

9. The method of claim 1, wherein the transfer pump and the high pressure pump are integrated into a common pump housing which is fluidly connected to receive a low pressure source of diesel fuel and to discharge into a high pressure diesel fuel accumulator in a common rail system for injecting diesel fuel from the accumulator into combustion chambers of an internal combustion engine according to injection requirements which are determined and satisfied by an engine management control system, and wherein the step of pre-metering is preceded by determining a desired pre-metered fuel charging quantity in response to a control system computation of desired fuel delivery and desired accumulator pressure.

10. The method of claim 1, wherein the transfer pump raises the pressure of said fuel by 200–300 psi.

11. A method for operating a diesel fuel pump system including a positive displacement transfer pump and a high pressure pump integrated into a common fuel pump housing which is fluidly connected to receive a low pressure source of diesel fuel from a reservoir and to discharge into a high pressure diesel fuel accumulator in a common rail system for injecting diesel fuel from the accumulator into combustion chambers of an internal combustion engine according to injection requirements which are determined and controlled by an engine management control system, comprising:

pre-metering successive quantities of fuel from the reservoir to said positive displacement transfer pump according to a control signal from the control system;

actuating the transfer pump to raise the pressure of the successive quantities of fuel by at least about 100 psi;

delivering each quantity of fuel which was pressurized in the transfer pump, to a high pressure pumping chamber, so the chamber receives a certain charge of fuel commensurate with said pre-metered quantity, within a first time interval;

simultaneously actuating a plurality of plungers into the pumping chamber to increase the pressure in the pumping chamber to said high pressure within a second time interval;

wherein said second time interval is of longer duration than said first time interval; and wherein each pre-metered quantity is delivered to said transfer pump during an intake time interval which is longer than said first time interval.

12. The method of claim 11, wherein the transfer pump intake interval is greater than said second time interval.

13. The method of claim 11, wherein the plungers can be actuated at a variable rate which depends on the quantity of fuel transferred to the pumping chamber.

14. In a high pressure hydraulic pump assembly having, a pump body including a pumping chamber with a plurality of pumping bores;

a plunger mounted in each plunger bore for reciprocation therein;

rotary cam means having a first cam profile rotatable about a cam axis for reciprocating the plungers simultaneously to provide alternating charging and pumping phases of operation for respectively receiving a charge of fuel in the pumping chamber at a charging pressure and delivering a discharge of fuel from the pumping chamber at a higher discharge pressure, wherein consecutive charging and pumping phases establish one plunger cycle defined by a reference angle of rotation of said cam means over a reference time period;

drive means for continuously rotating said cam means;

fuel transfer means, for delivering fuel from a fuel reservoir external to the pump, into said pump body;

inlet valve means for supplying charges of fuel from the fuel transfer means at said charging pressure to the pumping chamber during the charging phase; and discharge valve means for supplying fuel discharged from the pumping chamber at said high pressure, to at least one high pressure discharge outlet;

a method of operating the fuel transfer means comprising:

pre-metering successive quantities of fuel from the reservoir; and actuating the fuel transfer means with a second cam profile rotatable by said drive means, thereby increasing the pressure of the fuel from the reservoir by at least about 200 psi to provide a pre-metered quantity of fuel at a charging pressure of at least about 200 psi, to the inlet valve means.

15. The method of claim 14, wherein the step of increasing the pressure by at least about 200 psi is performed while the plunger is in said intake phase of operation.

16. The method of claim 15, wherein the transfer pump is a piston pump having an intake stroke and a discharge stroke which together establish a piston cycle, and said pre-metered quantity is supplied to the intake stroke of the piston pump while the pumping plunger is in the pumping phase.

17. The method of claim 16, wherein said intake and discharge strokes of the piston are controlled by said second cam profile such that said piston cycle has a time duration equal to said reference time period, and said discharge stroke of the piston is performed over a shorter time interval than the time interval for performance of the piston intake stroke.

18. The method of claim 17, wherein the pumping phase of operation of the plunger is performed over a longer time interval than the performance of the charging phase of operation of the plunger.

19. The method of claim 18, wherein the pumping phase of operation of the plunger is performed within the time interval for performing the intake stroke of the piston.

20. The method of claim 14, wherein the charging phase of operation includes a charging portion during which the volume of fuel in the pumping chamber increases and a floating portion following said charging portion and preceding said pumping phase, during which the volume of fuel in the pumping chamber remains constant, and the duration of the floating phase is dependent on the volume of said pre-metered fuel quantity.

21. The method of claim 20, wherein the plunger motion during the pumping phase is activated by a dual rate pumping profile on the cam, during steady state fuel demand the plunger floats relative to the cam profile for a relatively long interval until actuated for the pumping phase by a low rate portion of the pumping profile, and during transient fuel demand the plunger floats a relatively short interval until actuated for pumping phase by a high rate portion of the pumping profile.

22. A high pressure hydraulic pump assembly comprising:

a housing;

a pump body within the housing including a pumping chamber with a plurality of pumping bores;

a plunger mounted in each pumping bore for reciprocation therein;

a cam ring within the housing, surrounding the body, and rotatable about a cam axis, the cam ring having an inner profile for reciprocating the plungers to provide alternating charging and pumping phases of operation for respectively receiving a charge of fuel in the pumping chamber at a charging pressure and delivering a discharge of fuel from the pumping chamber at a higher discharge pressure;

fuel transfer means mounted in said housing, for delivering fuel from a fuel reservoir external to the pump, into said pump body;

inlet valve means in said body for supplying charges of fuel from the fuel transfer means at said charging pressure to the pumping chamber during the charging phase;

discharge valve means in said body for supplying fuel discharged from the pumping chamber at said high pressure, to at least one high pressure discharge outlet;

wherein said cam ring has an outer profile, and said fuel transfer means includes a positive displacement transfer pump directly actuated by the outer profile of said cam ring, for raising the pressure of the fuel from the reservoir to the inlet valve means, by at least about 200 psi.

23. In a high pressure hydraulic supply pump with a central pumping chamber and multiple simultaneously pumping plungers which are caused to reciprocate according to a plunger cam profile, and a positive displacement transfer pump having a reciprocating piston actuated according to a piston cam profile, said plunger cam profile and said piston cam profile having the same cycle time, wherein the improvement comprises said cam profiles having a relationship during each of said cycles, such that:

the transfer piston cam profile has a transfer ascending portion which reaches a transfer apex and a transfer descending portion which then descends continuously from the transfer apex to a transfer minimum, wherein the transfer descending portion is of greater duration during said cycle, than said transfer ascending portion; and said pumping plunger cam profile has a pump apex at the time in the cycle when said transfer piston cam profile has a minimum, a pump descending portion which descends to a pump minimum over a duration less than 50% of said cycle, and a pump ascending portion which then increases from said pump minimum along a high rate region followed by an increase along a lower rate region until said pump apex is reached.

24. The cam profile relationship of claim 23, wherein said high rate region and said low rate region together span at least 50% of the pumping cycle, and said high rate region spans between about 10% and 20% of said cycle.

25. The cam profile relationship of claim 24, wherein each plunger is supported for cooperation with said plunger cam profile, such that the plunger loses contact with the pump descending portion before making contact with the pump ascending portion, thereby defining a float period which constitutes approximately 10–50% of the cycle, and the particular float period during any particular pumping cycle, is dependent on the quantity of fuel discharged from the transfer pump during transfer piston actuation along the transfer ascending portion of the transfer piston cam profile.

26. The cam profile relationship of claim 25, wherein for the maximum capacity quantity delivered by the transfer pump, the float period is terminated as a result of the plunger contacting the high rate region of the pump ascending portion, and for a lesser quantity of fuel delivered by the transfer pump during steady state operation, the float duration is terminated by the plunger contacting the low rate region of said pump ascending portion.

* * * * *